US012371858B2

(12) United States Patent
Taniguchi et al.

(10) Patent No.: US 12,371,858 B2
(45) Date of Patent: Jul. 29, 2025

(54) FIBER WEB PRODUCT AND MANUFACTURING METHOD OF THE SAME

(71) Applicant: KAWANO PAPER CO., LTD., Kochi (JP)

(72) Inventors: Kenji Taniguchi, Hasuda (JP); Yuta Tanpo, Hasuda (JP)

(73) Assignee: KAWANO PAPER CO., LTD., Kochi (JP)

( * ) Notice: Subject to any disclaimer, the term of this patent is extended or adjusted under 35 U.S.C. 154(b) by 0 days.

(21) Appl. No.: 17/916,872

(22) PCT Filed: Jun. 14, 2022

(86) PCT No.: PCT/JP2022/023751
§ 371 (c)(1),
(2) Date: Oct. 4, 2022

(87) PCT Pub. No.: WO2023/067846
PCT Pub. Date: Apr. 27, 2023

(65) Prior Publication Data

US 2024/0352676 A1 Oct. 24, 2024

(30) Foreign Application Priority Data

Oct. 22, 2021 (JP) ..... 2021-173165

(51) Int. Cl.
*D21H 27/40* (2006.01)
*D21H 17/02* (2006.01)
(Continued)

(52) U.S. Cl.
CPC ..... *D21H 27/40* (2013.01); *D21H 17/02* (2013.01); *D21H 17/04* (2013.01); *D21H 17/06* (2013.01);
(Continued)

(58) Field of Classification Search
CPC ..... D21H 27/40; D21H 17/02; D21H 17/04; D21H 7/06; D21H 17/28; D21H 19/14; D21H 23/22; A47K 10/16
See application file for complete search history.

(56) References Cited

U.S. PATENT DOCUMENTS 5,575,891 A 11/1996 Trokhan et al.
5,935,384 A 8/1999 Taniguchi
(Continued)

FOREIGN PATENT DOCUMENTS

CN 101478876 B * 10/2013 ..... A01N 25/00
CN 116348020 A * 6/2023 ..... A47K 10/16
(Continued)

OTHER PUBLICATIONS

Machine Translation of JP 2007143764 A (Year: 2007).*
(Continued)

*Primary Examiner* — Jose A Fortuna
(74) *Attorney, Agent, or Firm* — Birch, Stewart, Kolasch & Birch, LLP

(57) ABSTRACT

A fiber web containing hardwood pulp is impregnated with a chemical solution that contains a moisturizing component such as glycerin, moisture, an oily component such as hydrocarbons, and a vegetable powder such as corn starch. The vegetable powder enters between pulp fibers of the fiber web in which hydrogen bonds are relaxed by the moisturizing component and the oily component, thereby spontaneously raising some of the pulp fibers in a surface of the fiber web. Accordingly, a fiber web product that is excellent in texture characteristics such as a smooth raised feeling, softness, and moistness, generates less dust such as powder or pulp fibers, and has sufficient strength, and a manufacturing method of the same are provided.

20 Claims, 3 Drawing Sheets

(51) Int. Cl.

| | |
|---|---|
| ***D21H 17/04*** | (2006.01) |
| ***D21H 17/06*** | (2006.01) |
| ***D21H 17/28*** | (2006.01) |
| ***D21H 19/14*** | (2006.01) |
| ***D21H 23/22*** | (2006.01) |

(52) U.S. Cl.
CPC ..... *D21H 17/28* (2013.01); *D21H 19/14* (2013.01); *D21H 23/22* (2013.01)

(56) References Cited

U.S. PATENT DOCUMENTS

| | | | | |
|---|---|---|---|---|
| 6,964,725 | B2 * | 11/2005 | Shannon | D21H 17/59 162/149 |
| 7,029,756 | B2 * | 4/2006 | Moline | D21H 27/38 428/452 |
| 8,894,814 | B2 * | 11/2014 | Wenzel | D21H 27/30 162/185 |
| 9,603,360 | B2 * | 3/2017 | Luu | A61K 8/068 |
| 10,517,982 | B2 * | 12/2019 | Vega | A61L 15/26 |
| 11,987,935 | B2 * | 5/2024 | Spender | D21H 17/74 |
| 12,018,435 | B2 * | 6/2024 | Spender | D21H 17/24 |
| 2003/0097102 | A1 | 5/2003 | Taniguchi | |
| 2004/0234804 | A1 | 11/2004 | Liu et al. | |
| 2009/0008052 | A1 | 1/2009 | Konuma | |
| 2010/0136294 | A1 * | 6/2010 | Manifold | D04H 1/4374 156/278 |
| 2011/0123578 | A1 | 5/2011 | Wenzel et al. | |
| 2013/0101817 | A1 | 4/2013 | Iwasaki | |
| 2013/0292044 | A1 * | 11/2013 | Wenzel | A61K 8/0208 156/226 |
| 2016/0263273 | A1 * | 9/2016 | Vega | A61F 13/51113 |
| 2020/0085994 | A1 * | 3/2020 | Vega | A61F 13/8405 |
| 2022/0267960 | A1 * | 8/2022 | Bilodeau | D21H 17/34 |
| 2024/0352676 | A1 * | 10/2024 | Taniguchi | D21H 17/28 |

FOREIGN PATENT DOCUMENTS

| | | | | |
|---|---|---|---|---|
| CN | 114040917 | B * | 10/2024 | C07H 13/06 |
| EP | 1 985 755 | A1 | 10/2008 | |
| EP | 1992367 | B1 * | 6/2012 | A61F 13/4902 |
| EP | 2501265 | B1 * | 1/2016 | A61K 8/0208 |
| EP | 2414589 | B1 * | 12/2017 | A47K 10/00 |
| EP | 4194609 | A1 * | 6/2023 | D21H 27/002 |
| EP | 4004283 | B1 * | 9/2024 | D21H 17/05 |
| GB | 2583036 | A * | 10/2020 | A01N 25/34 |
| JP | 9-154764 | A | 6/1997 | |
| JP | 10-513232 | A | 12/1998 | |
| JP | 2001-11790 | A | 1/2001 | |
| JP | 2003-199685 | A | 7/2003 | |
| JP | 2007-143764 | A | 6/2007 | |
| JP | 2007-204868 | A | 8/2007 | |
| JP | 2008-80027 | A | 4/2008 | |
| JP | 2008-80028 | A | 4/2008 | |
| JP | 2012-10907 | A | 1/2012 | |
| JP | 2013-511508 | A | 4/2013 | |
| JP | 2023062954 | A * | 5/2023 | D21H 27/002 |
| WO | WO 96/24719 | A2 | 8/1996 | |
| WO | WO 2007/061023 | A1 | 5/2007 | |
| WO | WO-2010106447 | A2 * | 9/2010 | A47K 10/00 |
| WO | WO-2023067846 | A1 * | 4/2023 | A47K 10/16 |

OTHER PUBLICATIONS

Extended European Search Report for European Application No. 22773384.7, dated Feb. 21, 2024.

International Search Report, issued in PCT/JP2022/023751, PCT/ISA/210, dated Aug. 16, 2022.

Written Opinion of the International Searching Authority, issued in PCT/JP2022/023751, PCT/ISA/237, dated Aug. 16, 2022.

* cited by examiner

[Fig. 1]
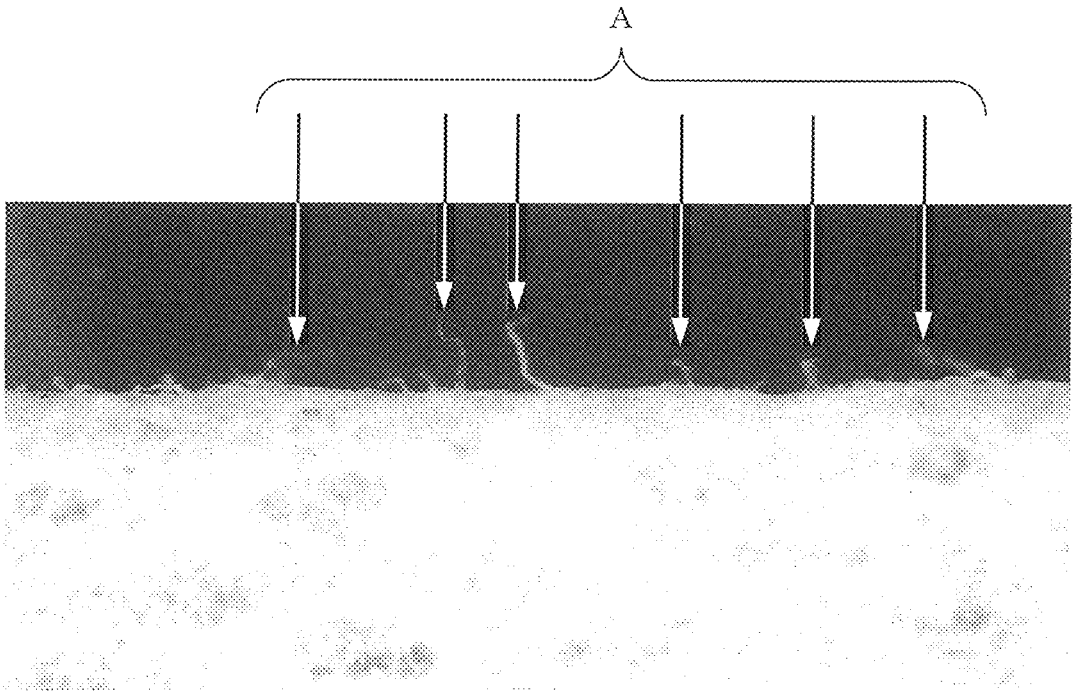

[Fig. 2]
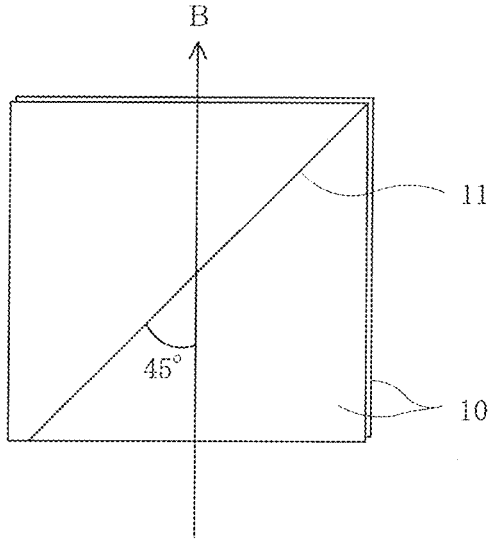
[Fig. 3]
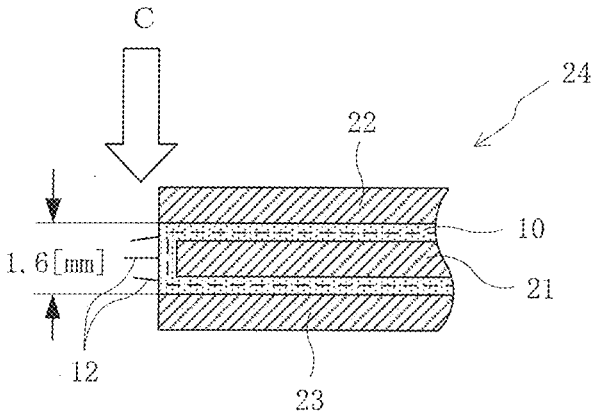

[Fig. 4]
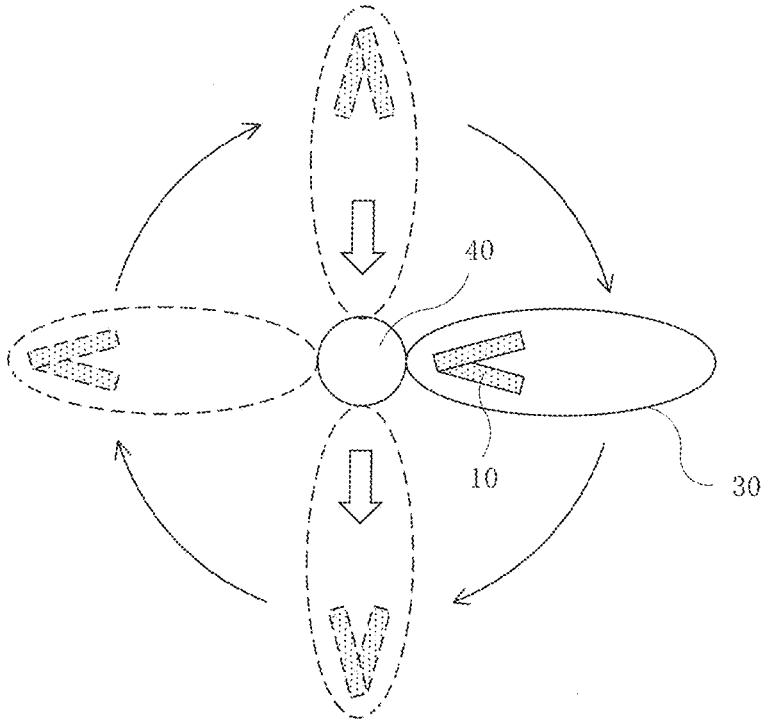
[Fig. 5]
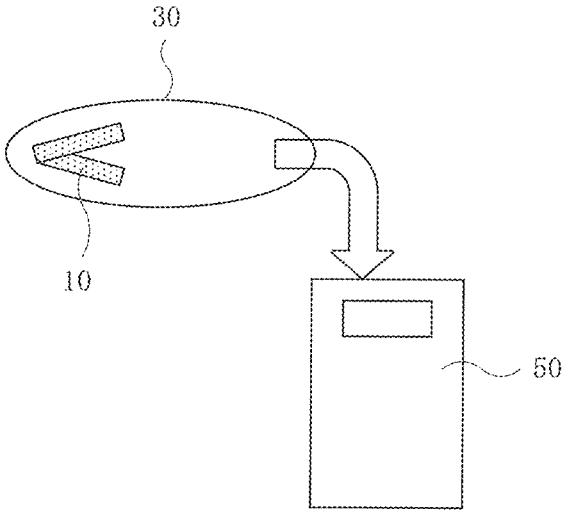

FIBER WEB PRODUCT AND MANUFACTURING METHOD OF THE SAME

CROSS-REFERENCE TO RELATED APPLICATIONS

This application is the National Phase of PCT International Application No. PCT/JP2022/023751, filed on Jun. 14, 2022, which claims priority under 35 U.S.C. § 119(a) to Patent Application No. 2021-173165, filed in Japan on Oct. 22, 2021, each of which are hereby expressly incorporated by reference into the present application.

FIELD

The present invention relates to a fiber web product used for hygienic and household uses such as tissue paper, toilet paper, and towel paper and in which a fiber web is impregnated with a chemical solution containing predetermined components, and a manufacturing method of the same.

BACKGROUND

As a background technique, for example, Japanese Patent Application Laid-open No. H5-156596 discloses a highly moisture-retaining fiber web product in which a fiber web is impregnated with a moisturizer to provide a moist feeling in order to improve softness and texture.

Patent Japanese Patent Application Laid-open No. 2001-11790 discloses a fiber web product in which a powder composed of an inorganic substance or an organic substance or a mixture thereof and a moisturizing component are contained in a fiber web to improve an oil-absorbing property, a dry feeling and flexibility.

Further, Patent Japanese Patent Application Laid-open No. 2007-204868 discloses chemical-solution-containing tissue paper in which a chemical solution containing a plurality of types of powders having different average particle diameters is contained in base paper, and Patent Japanese Patent Application Laid-open No. 2008-80027 discloses chemical-solution-containing tissue paper in which talc having a predetermined particle diameter, a paper softener, and a moisturizing component are contained in base paper. Both of them aim to improve a dry feeling, a smooth feeling, and softness of the tissue paper.

Patent Japanese Patent Application Laid-open No. 2003-342899 describes improvement of softness and a fluffy feeling of sanitary tissue paper with crepe by raising pulp fibers in the surface of the paper by a physical method. As the physical method described above, there is disclosed a method in which the pulp fibers are peeled off by cutting or the like or rubbed with a plurality of needles or the like arranged on an outer circumferential surface of a roller.

CITATION LIST

Patent Literatures

Patent Literature 1: Japanese Patent Application Laid-open No. H5-156596

Patent Literature 2: Japanese Patent Application Laid-open No. 2001-11790

Patent Literature 3: Japanese Patent Application Laid-open No. 2007-204868

Patent Literature 4: Japanese Patent Application Laid-open No. 2008-80027

Patent Literature 5: Japanese Patent Application Laid-open No. 2003-342899

SUMMARY

Technical Problem

As for the fiber web product according to Patent Japanese Patent Application Laid-open No. H5-156596, smoothness of the surface is still not enough although the moist feeling is high. Therefore, the fiber web product has to be further improved as a fiber web product used for sensitive skin.

In the fiber web product according to Patent Japanese Patent Application Laid-open No. 2001-11790, the dry feeling and the smooth feeling of the surface are improved. However, when no adhesive component is contained, an effect of preventing the powder from falling off is insufficient.

In addition, Patent Japanese Patent Application Laid-open No. 2001-11790 fails to refer to raising of the pulp fibers.

The chemical-solution-containing tissue paper according to each of Patent Literatures 3 and 4 fails to disclose knowledge related to prevention of the power from falling off and to raising of the pulp fibers.

Further, the sanitary tissue paper according to Patent Japanese Patent Application Laid-open No. 2003-342899 has a problem that machines or devices such as a roller and its driving mechanism are required in a process of physically and forcibly raising the pulp fibers and a problem that paper powder can be easily generated by excessive breakage of the pulp fibers, for example.

Therefore, it is an object of the present invention to provide a fiber web product that can spontaneously generate thick raised fibers without using various machines and devices only by impregnating a fiber web with a chemical solution in which a specific moisturizing component, moisture, an oily component, and a vegetable powder are blended at a predetermined ratio, and that is excellent in texture characteristics such as softness and a moist feeling, and to provide a manufacturing method of the same.

It is another object of the present invention to provide a fiber web product capable of reducing generation of dust such as powder and pulp fibers, and a manufacturing method of the same.

Solution to Problem

In order to solve the above problems, a fiber web product according to the present invention is characterized in that a fiber web containing hardwood pulp is impregnated with a chemical solution containing a moisturizing component, moisture, an oily component, and a vegetable powder.

As the fiber web according to the present invention, it is preferable to use dry crepe paper in which crepe is formed by a doctor blade on a dryer of a paper machine during papermaking. The dry crepe paper contains hardwood pulp as wood fibers, and may further contain softwood pulp as other wood fibers and one type or a plurality types of non-wood plant fibers (for example, hemp, bast fibers, cotton, or kenaf), rayon fibers, and synthetic fibers (for example, nylon, polyethylene, polyester, or polypropylene).

Pulp fibers preferably contain wood fibers and non-wood plant fibers that are plasticized by moisture, and preferably contain hardwood pulp and softwood pulp that are wood fibers in a total amount of 80 [wt %] or more with respect to the fiber web. In particular, with respect to the fiber web, the pulp fibers contain 50 [wt %] or more, preferably 70 [wt %] or more, more preferably 80 [wt %] or more, and most preferably 90 [wt %] or more of hardwood pulp.

Since hardwood pulp has shorter and thinner fibers than softwood pulp, the number of hydrogen bond points and the bonding area between pulp fibers are small, and the bonds between pulp fibers are easily broken due to presence of the moisturizing component, the moisture, the oily component, and the vegetable powder in the chemical solution, so that raising of fibers in the surface of the fiber web easily occurs due to release of pulp fibers. Further, since hardwood pulp has a larger number of fibers per unit weight than softwood pulp, the number of raised pulp fibers is also larger.

For the reasons described above, it is desirable that the amount of hardwood pulp in the fiber web is as large as possible.

The moisturizing component in the chemical solution in the present invention has a function of taking in moisture from a surrounding environment to improve the moisture content retained in the pulp fibers and soften the pulp fibers.

Examples of the moisturizing component include polyhydric alcohols such as glycerin, diglycerin, polyglycerin, polyethylene glycol (average molecular weight: 200 or more and less than 1000), propylene glycol, 1,3-butylene glycol, ethylene glycol, and diethylene glycol; sugar alcohols such as sorbitol, xylitol, erythritol, mannitol, lactitol, oligosaccharide alcohol, maltitol, and reduced starch hydrolysate; fructose, glucose, oligosaccharide, trehalose, glycine betaine, pyrrolidone carboxylic acid, pyrrolidone carboxylic acid salts, and sodium lactate.

Among these components, glycerin is suitable as the moisturizing component because of its high hygroscopicity. Further, sorbitol is excellent in the ability to retain moisture, and therefore can enhance stability of the moisture content against changes in the surrounding environment by being used with glycerin.

The moisture contained in the fiber web product of the present invention includes the moisture in the chemical solution and moisture absorbed from the surrounding environment by a moisturizing component or the like. The amount of the moisture absorbed from the surrounding environment is changed depending on absorbency of the moisturizing component and the humidity of the surrounding environment. Therefore, it is desirable to expect the amount of the moisture absorbed from the surrounding environment in advance, determine the amount of the moisture in the chemical solution based on the expected amount, and perform blending.

The oily component in the chemical solution makes a pulp surface smooth and gives smooth touch by transferring to the skin. Further, because of viscosity of the oily component, dust including the vegetable powder, the pulp fibers, or the like can be prevented from falling off.

The oily component described above is desirably blended by being emulsified in the moisture or the moisturizing component by a surfactant in the form of an oil-in-water type.

Examples of the oily component include hydrocarbons such as liquid paraffin, solid paraffin, and squalane; vegetable oils such as olive oil, camellia oil, castor oil, and soybean oil; fatty acids such as stearic acid, palmitic acid, myristic acid, and lauric acid; waxes such as beeswax, carnauba wax, and lanolin; higher alcohols such as lauryl alcohol, cetyl alcohol, stearyl alcohol, and oleyl alcohol; and esters such as isopropyl myristate and isopropyl palmitate. Among these oily components, hydrocarbons and vegetable oils are preferable, saturated hydrocarbons that are not easily oxidized are more preferable, and hydrocarbons that are liquid at 23 [° C.] are most preferable.

Suitable examples of the surfactant include nonionic surfactants such as sucrose fatty acid esters, sorbitan fatty acid esters, glycerin fatty acid esters, polyoxyethylene alkyl ethers, polyoxyethylene fatty acid esters, and polyoxyethylene sorbitan fatty acid esters; and anionic surfactants such as fatty acid salts, alkylbenzene sulfonates, and polyoxyethylene alkyl ether sulfates.

The powder in the chemical solution is preferably a vegetable powder having a high affinity for moisture, produces a smooth feeling, and enters (intervenes) between pulp fibers to promote raising.

Examples of the vegetable powder include a wood powder, a bamboo powder, a vegetable fiber powder, a cellulose powder, and starches. The shape of the vegetable powder is preferably spherical or polyhedral, and starches are particularly preferable in terms of availability and safety. As the starches, corn starch, potato starch, rice flour, wheat flour, and the like are preferable, and corn starch is most preferable.

The average particle diameter of the vegetable powder is preferably 2 to 50 [μm], more preferably 5 to 30 [μm].

When the temperature of the starch is raised in the presence of moisture, starch particles are dissolved due to gelatinization and the form of powder cannot be maintained. In addition, hydrogen bonds are formed between pulp fibers due to gelatinized starch to increase the strength of the fiber web product more than necessary, so that the product becomes hard.

Therefore, when the starch is used as the vegetable powder in the present invention, it is desirable to blend the starch while maintaining the temperature of emulsion containing the moisturizing component, the moisture, the oily component, and the surfactant at 60 [° C.] or less in a chemical solution preparation process, and to impregnate the fiber web at a temperature of 60 [° C.] or less also in a chemical solution impregnation process. For both the chemical solution preparation process and the chemical solution impregnation process, the temperature range is more desirably 50 [° C.] or less, and further desirably 45 [° C.] or less.

A chemical solution preparation process and a chemical solution impregnation process in a manufacturing method according to the present invention are described below.

(1) Chemical Solution Preparation Process

A chemical solution with which a fiber web is impregnated contains the moisturizing component, the moisture, the oily component, and the vegetable powder that have been described above as essential components, contains a surfactant as necessary, and does not contain an adhesive component for making the vegetable powder adhere to the fiber web and preventing the vegetable powder from falling off, for example, carboxymethylcellulose sodium, polyvinyl alcohol, water-soluble urethane resin, latex, or starch paste obtained by gelatinization of starch at a temperature of 60 [° C.] or higher.

The preparation of the chemical solution is performed by adding the surfactant to the oily component as necessary, heating and mixing the mixture, further adding water and the moisturizing component to form an oil-in-water type emulsion, and then adding the vegetable powder to the emulsion while stirring to form a suspension. As described above, when starch is blended as the vegetable powder, blending is performed at a temperature of 60 [° C.] or lower.

A blending ratio of the moisturizing component, the moisture, the oily component, and the vegetable powder in the chemical solution at 23 [° C.] and a relative humidity of 50[%] is preferably 1:0.05 to 1.0:0.01 to 1.0:0.01 to 1.0, and more preferably 1:0.1 to 0.5:0.03 to 0.5:0.03 to 0.5.

(2) Chemical Solution Impregnation Process

A method for impregnating a fiber web with the chemical solution prepared as described above may be to perform spraying of the chemical solution using a spray device (spraying), coating of the chemical solution using a printing roll (roll coating), or the like.

An impregnation rate of the chemical solution to the fiber web is preferably 1 to 60 [wt %]. When the impregnation rate is less than 1 [wt %], an effect of improving the texture is small. When the impregnation rate exceeds 60 [wt %], the strength is lowered and the effect of improving the texture cannot be increased anymore. Therefore, when the impregnation rate of the chemical solution is set to 1 to 60 [wt %], there is no problem in practical use. Further, the content rate is preferably set to 10 to 50 [wt %], and more preferably 20 to 40 [wt %] in order to improve the texture and to achieve a good balance between the texture and the strength.

Advantageous Effects of Invention

According to the present invention, a fiber web product can be provided which is excellent in texture such as a smooth raised feeling of a fiber web surface, softness, a moist feeling, and non-stickiness, and which hardly generates dust such as powder and pulp fibers and hardly allows the dust to fall off without blending an adhesive component, by setting the types of the pulp fibers and the amounts of a moisturizing component, moisture, an oily component, and a vegetable powder to be blended in a chemical solution to specific ranges. In addition, it is possible to obtain a fiber web product that has a sufficient strength, is excellent in practicality, and is most suitable for sanitary use and household use.

Further, only by impregnating the fiber web with the chemical solution with the powder dispersed therein, it is possible to cause powder particles to intervene between the pulp fibers due to relaxation of hydrogen bonds between the pulp fibers by the moisturizing component and the oily component in the chemical solution, so that the pulp fibers are raised spontaneously. Therefore, there is no need for a raising process by a physical method in which protrusions are pressed against the surface of the fiber web to forcibly peel off and pull out some fibers, and there is no need to use a special machine or device.

BRIEF DESCRIPTION OF DRAWINGS

FIG. 1 is a diagram (a photograph) illustrating a state of raising of pulp fibers.

FIG. 2 is an explanatory diagram of a sample for measuring the number of raised fibers.

FIG. 3 is a sectional diagram schematically illustrating a state of a raising of a specimen.

FIG. 4 is an explanatory diagram of a dust particle measurement method.

FIG. 5 is an explanatory diagram of the dust particle measurement method.

DESCRIPTION OF EMBODIMENTS

Embodiments of the present invention will now be explained with reference to the drawings.

Table 1 represents blending of components and various evaluation results in examples in which an embodiment of the present invention is embodied, and Table 2 represents blending of components and various evaluation results in comparative examples.

TABLE 1

| | | | Examples | | | | |
|---|---|---|---|---|---|---|---|
| | | | 1 | 2 | 3 | 4 | 5 |
| Base Paper | Pulp blending ratio [%] | Hardwood | 50 | 70 | 80 | 90 | 90 |
| | | Softwood | 50 | 30 | 20 | 10 | 10 |
| | | Basis weight [g/m$^2$] | 15 | 15 | 15 | 15 | 15 |
| Chemical-solution part by weight | Moisturizing component and moisture | Glycerin (98. 5 [%] or more) | 60 | 60 | 60 | 60 | 60 |
| | | Sorbitol (Solid content 70 [%]) | 10 | 10 | 10 | 10 | 10 |
| | | Water | 20 | 20 | 20 | 20 | 20 |
| | Oily component | Liquid paraffin (Pour point −12.5 [° C.]) | 5 | 5 | 5 | 5 | 5 |
| | | Squalane (Pour point −38 [° C.]) | | | | | |
| | | Solid paraffin (Melting point 46 to 48 [° C.]) | | | | | |
| | Powder Vegetable | Corn starch (Average particle diameter 14 [μm]) | 5 | 5 | 5 | 5 | 10 |
| | | Potato starch (Average particle diameter 40 [μm]) | | | | | |
| | Mineral | Talc (Average particle diameter 5.1 [μm]) | | | | | |
| | | Kaolin (Average particle diameter 4.8 [μm]) | | | | | |
| | Surfactant | Mixture of polyoxyethylene sorbitan fatty acid ester and sorbitan fatty acid ester | 1 | 1 | 1 | 1 | 1 |
| | Chemical-solution impregnation ratio [%] | | 25 | 25 | 25 | 25 | 25 |
| Evaluation results | Number of raised fibers | Fibers | 476 | 526 | 681 | 847 | 1272 |
| | Dust | Particles | 1386 | 1402 | 1539 | 1650 | 1823 |
| | Touch | Smooth raised feeling | ○ | ○ | ○ | ◎ | ◎ |
| | | Softness | ○ | ○ | ◎ | ◎ | ◎ |
| | | Moistness | ◎ | ◎ | ◎ | ◎ | ◎ |
| | | Non-stickiness | ◎ | ◎ | ◎ | ◎ | ◎ |
| | Strength (longitudinal) | N | 2.28 | 2.11 | 2.02 | 1.82 | 1.88 |

TABLE 1-continued

| | | | Examples | | | |
|---|---|---|---|---|---|---|
| | | | 6 | 7 | 8 | 9 |
| Base Paper | Pulp blending ratio [%] | Hardwood | 90 | 80 | 80 | 80 |
| | | Softwood | 10 | 20 | 20 | 20 |
| | | Basis weight [g/m$^2$] | 15 | 15 | 15 | 15 |
| Chemical-solution part by weight | Moisturizing component and moisture | Glycerin (98. 5 [%] or more) | 60 | 60 | 60 | 60 |
| | | Sorbitol (Solid content 70 [%]) | 10 | 10 | 10 | 10 |
| | | Water | 20 | 20 | 20 | 20 |
| | Oily component | Liquid paraffin (Pour point −12.5 [° C.]) | 2 | | | 5 |
| | | Squalane (Pour point −38 [° C.]) | | 5 | | |
| | | Solid paraffin (Melting point 46 to 48 [° C.]) | | | 5 | |
| | Powder Vegetable | Corn starch (Average particle diameter 14 [μm]) | 10 | 5 | 5 | |
| | | Potato starch (Average particle diameter 40 [μm]) | | | | 5 |
| | Mineral | Talc (Average particle diameter 5.1 [μm]) | | | | |
| | | Kaolin (Average particle diameter 4.8 [μm]) | | | | |
| | Surfactant | Mixture of polyoxyethylene sorbitan fatty acid ester and sorbitan fatty acid ester | 0.4 | 1 | 1 | 1 |
| | Chemical-solution impregnation ratio [%] | | 25 | 25 | 25 | 25 |
| Evaluation results | Number of raised fibers | Fibers | 818 | 667 | 482 | 644 |
| | Dust | Particles | 3822 | 1705 | 1727 | 2278 |
| | Touch | Smooth raised feeling | ○ | ○ | ○ | ○ |
| | | Softness | ◎ | ◎ | ○ | ○ |
| | | Moistness | ◎ | ◎ | ◎ | ◎ |
| | | Non-stickiness | ◎ | ◎ | ○ | ◎ |
| | Strength (longitudinal) | N | 1.80 | 1.92 | 1.72 | 1.98 |

TABLE 2

| | | | Comparative examples | | | | | | |
|---|---|---|---|---|---|---|---|---|---|
| | | | 1 | 2 | 3 | 4 | 5 | 6 | 7 |
| Base Paper | Pulp blending ratio [%] | Hardwood | 80 | 80 | 80 | 70 | 0 | 70 | 0 |
| | | Softwood | 20 | 20 | 20 | 30 | 100 | 30 | 100 |
| | | Basis weight [g/m$^2$] | 15 | 15 | 15 | 15 | 15 | 15 | 15 |
| Chemical-solution part by weight | Moisturizing component and moisture | Glycerin (98.5 [%] or more) | 60 | 60 | 60 | 60 | 60 | | |
| | | Sorbitol (Solid content 70 [%]) | 10 | 10 | 10 | 10 | 10 | | |
| | | Water | 20 | 20 | 20 | 20 | 20 | | |
| | Oily component | Liquid paraffin (Pour point −12.5 [° C.]) | 5 | 5 | | 5 | 5 | | |
| | | Squalane (Pour point −38 [° C.]) | | | | | | | |
| | | Solid paraffin (Melting point 46 to 48 [° C.]) | | | | | | | |
| | Powder Vegetable | Corn starch (Average particle diameter 14 [μm]) | | | 5 | | 5 | | |
| | | Potato starch (Average particle diameter 40 [μm]) | | | | | | | |
| | Mineral | Tale (Average particle diameter 5.1 [μm]) | 5 | | | | | | |
| | | Kaolin (Average particle diameter 4.8 [μm]) | | 5 | | | | | |
| | Surfactant | Mixture of polyoxyethylene sorbitan fatty acid ester and sorbitan fatty acid ester | 1 | 1 | | 1 | 1 | | |
| | Chemical-solution impregnation ratio [%] | | 25 | 25 | 25 | 25 | 25 | | |
| Evaluation results | Number of raised fibers | Fibers | 386 | 324 | 532 | 324 | 144 | 304 | 122 |
| | Dust | Particles | 21087 | 43749 | 7614 | 1764 | 1233 | 3594 | 1800 |
| | Touch | Smooth raised feeling | Δ | Δ | Δ | Δ | Δ | X | X |
| | | Softness | ○ | ○ | ○ | ○ | Δ | Δ | X |
| | | Moistness | ◎ | ◎ | ○ | ◎ | ○ | X | X |
| | | Non-stickiness | Δ | Δ | ◎ | Δ | Δ | ◎ | ◎ |
| | Strength (Longitudinal) | N | 1.36 | 1.49 | 1.88 | 1.94 | 4.45 | 2.24 | 5.23 |

In the first to ninth examples in Table 1, a pulp blending ratio, the type and amount of an oily component in a chemical solution, and the type of a vegetable powder were changed.

In the first and second comparative examples in Table 2, a mineral powder was blended to a chemical solution. In the third comparative example, neither an oily component nor a surfactant was blended. In the fourth comparative example, a powder was not blended. In the fifth comparative example, a fiber web contained only softwood pulp. In the sixth and seventh comparative examples, sheets of fiber web base paper were not impregnated with a chemical solution.

A papermaking method of a fiber web and a method for impregnating the fiber web with a chemical solution are as follows.

A pulp slurry of unbeaten NBKP (softwood kraft bleached pulp: weight-weighted average fiber length: 2.4 to 2.6 [mm], fiber coarseness: 0.148 [mg/m]) was beaten so that the down width of the Canadian Standard Freeness was 40 to 60 [ml]. In addition, a pulp slurry of LBKP (hardwood kraft bleached pulp: weight-weighted average fiber length: 0.60 to 0.72

[mm], fiber coarseness: 0.057 [mg/m]) was beaten so that the down width of the Canadian Standard Freeness was 30 to 40 [ml].

Subsequently, the pulps were mixed so as to achieve the pulp blending ratios described in Tables 1 and 2, and a wet strength agent was added in an amount of 0.2 [wt %] in terms of solid content per pulp. Thereafter, dry crepe paper was made by a usual method using a paper machine.

The obtained crepe paper had a basis weight of 15 [g/m$^2$] and a crepe ratio of 24[%]. Two sheets of the crepe paper were stacked and wound in a roll shape.

Next, each of the chemical solutions obtained by blending the components represented in Table 1 and Table 2 was continuously sprayed on the two-ply base paper from both sides thereof in an amount of 25 [wt %] per crepe paper, and the base paper was again wound into a roll. Thereafter, the rolled crepe paper was allowed to stand at room temperature for 24 hours or more, whereby the entire fiber web was uniformly impregnated with the chemical solution.

Next, a large number of samples were prepared by cutting the two-ply base paper into a size of 200 [mm] in the vertical direction (a papermaking direction) and 225 [mm] in the horizontal direction (a papermaking width direction) so that the dryer surface of the crepe paper was the front.

Each sample was then allowed to stand in an environment at a temperature of 23±5 [° C.] and a humidity of 50±5[%] for 24 hours or more, and was evaluated by performing the following sensory evaluation (texture test) and physical property test.

A. Sensory Evaluation (Texture Test)

Ten monitors touched each sample with their hands and evaluated the touch (a smooth raised feeling, softness, moistness, and non-stickiness) according to the following criteria.

That is, as for the smooth raised feeling, the softness, and the moistness, "very excellent" was given 3 points, "excellent" was given 2 points, "slightly excellent" was given 1 point, and "not excellent" was given 0 points. The scores given by the ten monitors were summed and ranked as follows.

"26 to 30 points": ◎
"16 to 25 points": ○
"6 to 15 points": Δ
"0 to 5 points": X According to the above ranking, ◎ represents that a corresponding sample is the most excellent, and X represents that a corresponding sample is the least excellent.

The stickiness due to the oily component was evaluated according to the following criteria.

That is, "strongly sticky feeling" was given 3 points, "sticky feeling" was given 2 points, "slightly sticky feeling" was given 1 point, and "no sticky feeling" was given 0 points. The scores given by the ten monitors were summed and ranked as follows.

"26 to 30 points": X
"16 to 25 points": Δ
"6 to 15 points": ○
"0 to 5 points": ◎

According to the above ranking, X represents the stickiest state, and ◎ represents the least sticky state.

B. Physical Property Test (1) Measurement of the Number of Raised Fibers (Degree of Raising)

A raised fiber defined herein is a single pulp fiber that protrudes from a fiber web surface and has one end in the longitudinal direction of the fiber in the fiber web and the other end rising from the fiber web surface. In this test, the number of fibers in raised fibers, in which the protruding height from the fiber web surface is 0.1 [mm] or more, is counted.

FIG. 1 is a diagram (a photograph) illustrating a state of raising of pulp fibers. When the number of raised fibers (raised-fiber number) denoted by arrows A in FIG. 1 is large and the raised fibers are soft, a thick and smooth texture is expressed. The number of raised fibers in which the protruding height from the fiber web surface is 0.1 [mm] or more is preferably 400 or more under a measurement condition described below, more preferably 500 or more, and further preferably 600 or more.

A specific method of measuring the number of raised fibers is as follows.

As illustrated in FIG. 2, a two-ply sample 10 is folded along a folding line 11 crossing a papermaking direction B at 45 degrees with a slide glass 21 interposed therebetween as illustrated in FIG. 3, and the folded sample 10 is sandwiched from both sides by other slide glasses 22 and 23. A specimen 24 is thus prepared.

The specimen 24 described above is set on a horizontally movable stage under a microscope, and a state of raising at an end of the specimen 24 is observed in a direction C perpendicular to the slide glasses 21 to 23.

The number of raised fibers 12 having a height of 0.1 [mm] or more in raised fibers protruding from the end of the specimen 24 is counted over a length of 2.5 [mm] of the sample 10 within a visual field of the microscope.

The series of measurements described above are performed 40 times while changing the measurement position on the sample 10, and the results are totaled to obtain the number of the raised fibers 12 per 100 [mm] in length of the sample 10.

As the slide glasses 21 to 23, those having a thickness of 1.3 [mm], a length of 76 [mm], and a width of 26 [mm] were used, and the observation magnification by the microscope was set to 40 times.

The measurement range of the sample 10 in this measurement is 100 [mm] in the lengthwise direction (L) and 1.6 [mm] in the widthwise direction (W), which is obtained by adding the thickness (0.15 [mm]×2) of the sample 10 to the thickness 1.3 [mm] of the slide glass 21. Therefore, the measurement area(S) is 160 [mm] from S=L×W. Although FIG. 3 illustrates a case of the two-ply sample 10, the sample may be one-ply or three or more ply. In addition, the width direction (W) of the measurement range is changed depending on the thickness of the sample 10, and in association with this change, the measurement area(S) is also changed. However, the number of raised fibers is obtained by converting the measurement area(S) to 160 [mm$^2$].

(2) Dust Particle Measurement

Powder and pulp fibers falling off when a mechanical impact is applied to a fiber web are defined as dust, and the number of dust particles is measured by a particle number measuring device.

The number of the dust particles is preferably 6000 or less, more preferably 5000 or less, and further preferably 4000 or less per 1800 [cm] of a surface area of the fiber web.

As a specific measurement method, a series of measurements described below was performed ten times to obtain a mean value of the number of dust particles.

First, as illustrated in FIG. 4, the sample 10 is placed in a plastic bag with zipper 30, and air is enclosed therein. The plastic bag 30 is set on a horizontal rotating shaft 40 of a rotating device and rotated at a rotation speed of 25 [times/min] for 10 minutes. As a result, an impact is applied to the sample 10 falling in any direction (mainly in the radial direction of a rotation path) within the plastic bag 30, and dust falls off from the sample 10.

Next, as illustrated in FIG. 5, the number of dust particles present in the plastic bag 30 is measured by a particle number measuring device 50. A value of a blank test (the number of dust particles in the plastic bag 30 in which the sample 10 is not enclosed) is then subtracted from the measured value, and the number of dust particles generated and falling off from the sample 10 is counted.

The measurement condition is as follows.

Rotating device: Scroller SCR-120 type (manufactured by Iuchi Seieido Co., Ltd.)

Plastic bag: 240 [mm] in width×340 [mm] in length×0.04 [mm] in thickness, capacity 4.0 [L]

Measured particle diameter of dust: 5 [μm] or more

Particle number measuring device: Particle monitor GT-32 (manufactured by SIBATA SCIENTIFIC TECHNOLOGY LTD.)

Measuring time: 60 [seconds]

Suction amount of air by particle number measuring device: 2.83 [L/min]

Size of sample in this measurement: 200 [mm] in length×225 [mm] in width, two-ply Surface area: 200 [mm]×225 [mm]×4 (both surfaces of two-ply paper)=1800 [$cm^2$]

The surface area varies depending on the size of the sample, and the number of dust particles is calculated in terms of the surface area of 1800 [$cm^2$].

(3) Strength Test

According to JIS S3104 (tissue paper), dry tensile strength in the longitudinal direction (the papermaking direction) of a fiber web was measured 10 times, and the mean value thereof was determined.

C. Evaluations

From the results of the tests described above, the following evaluations can be made.

(1) Examples

In the first to fourth examples in Table 1, only the pulp blending ratio was changed, and the components of the chemical solution and the chemical-solution impregnation ratio were the same.

According to the first to fourth examples, as a blending ratio of hardwood pulp gradually increases, softness, the number of raised fibers, and the number of dust particles also increase. This is considered to be because hardwood pulp has a shorter fiber length and a thinner fiber than softwood pulp, and therefore hydrogen bond points and hydrogen bond areas between pulp fibers are also narrow, and the sheet structure is easily loosened in the presence of the chemical solution. In addition, when the blending ratio of hardwood pulp is high, the absolute number of the pulp fibers is also large, and therefore the number of raised fibers is also increased.

The fifth example is an example in which the blending amount of the powder was increased from that in the fourth example. As compared to the fourth example, the number of the raised fibers was increased. It is considered that this increase is due to increase of the amount of the powder.

The sixth example is an example in which the amount of the oily component was reduced from that in the fifth example. The number of dust particles was increased from that in the fifth example. This is considered to be because an effect of adhering dust by the oily component was lowered.

In the seventh example, the type of the oily component in the third example was changed, and substantially equivalent evaluation results to those in the third example were obtained.

In the eighth example, a solid oily component was blended. Stickiness was slightly observed as compared to the third and seventh examples, and softness was also lowered.

In the ninth example, the type of the powder was changed from that in the third example, and softness was slightly lowered as compared to the third and seventh examples.

(2) Comparative Examples

In the first and second comparative examples in Table 2, powder was changed from a vegetable powder to a mineral powder such as talc or kaolin. The number of dust particles was incomparably larger than those in the first to ninth examples.

This is considered to be because particles of talc or kaolin are plate-like crystals and can easily peel off, and easily fall off and scatter from a fiber web to form dust, and because the average particle diameter of the powder is small, the number of powder particles per weight is large, and the effect of preventing the powder from falling off by a chemical agent is reduced.

In addition, in the first and second comparative examples, evaluation of a smooth raised feeling is also low. This is considered to be because the powder does not contribute to a smooth raised feeling accompanied by a feeling of thickness, although the smoothness is high due to a small average particle diameter of the powder.

In the third comparative example, the oily component was removed from the third example. The number of dust particles was considerably larger than that in the third example. From this result, it is effective to contain the oily component in a chemical agent for reducing dust.

The fourth comparative example is a sample in which only the powder was not blended in the second example. In the fourth comparative example, since the powder was removed, a sticky feeling due to the oily component was felt, and the number of raised fibers was decreased and evaluation of the raised feeling was also lowered.

In the fifth comparative example, pulp fibers contained only softwood pulp and did not contain hardwood pulp, and the number of raised fibers was small. The number of dust particles was the smallest among the comparative examples.

Since softwood pulp has thick and long fibers, hydrogen bonds between fibers are strong, and separation and raising of the pulp hardly occur in spite of the presence of the chemical solution. Further, since softwood pulp has a smaller number of fibers per area than hardwood pulp, the number of raised fibers is also smaller.

Further, since the average particle diameter of the powder is small as compared to the size of pulp fibers, the touch of the powder is low and stickiness due to the oily component is felt.

In the sixth and seventh comparative examples, sheets of base paper were not impregnated with the chemical solution.

Although the sixth comparative example and the second example have the same pulp blending ratio, the number of raised fibers is larger, and generation of dust is reduced in the second example in which the powder is contained in the chemical solution. In other words, as in examples including the second example, by impregnating the fiber web with the chemical solution containing the moisturizing component, the moisture, the oily component, and the vegetable powder in a predetermined blending ratio, thick raised fibers are effectively generated, and falling off of the pulp fibers and the powder is reduced.

(3) Summary

Pulp fibers in each example are raised by relaxation of hydrogen bonds between the pulp fibers due to a moisturizing component and an oily component and by intervention of powder (starch) between the pulp fibers. Therefore, a spontaneously generated raising state is obtained, unlike raising forcibly formed by a mechanical force as in the conventional technique.

When powder particles are too small as compared to the pulp fibers, an action of separating the pulp fibers from each other to promote raising is small. When the powder particles are too large, the powder is separated from the pulp fibers and falls off as dust. Therefore, by setting the average particle diameter of the powder to, for example, 2 to 50 [μm], and preferably 5 to 30 [μm], it is possible to generate appropriate raising, and to reduce generation and falling off of dust in cooperation with adhesiveness due to the oily component.

Further, since the raised pulp fibers are plasticized by the moisturizing component and smoothed by the oily component, the fibers give extremely soft touch when coming into contact with the skin.

Although each example contains an oily component, a sticky feeling was not felt so strongly.

The oily component is easily adsorbed to pulp fibers having higher lipophilicity than starch. Therefore, when the fiber web is brought into contact with the skin, an oily feeling of the pulp fibers and a non-oily feeling of the starch are simultaneously given, whereby smoothness without stickiness is expressed.

On the other hand, in a case where the thickness of the fibers is considerably larger than the particle diameter of the starch as in the softwood pulp of the fifth comparative example, for example, the starch is less likely to be touched and the oily feeling of the pulp fibers is strongly felt, when the fiber web surface is touched. The sticky feeling is thus considered to be increased.

In each example, there was a concern about decrease in paper strength due to intervention of the starch between the pulp fibers. However, decrease in strength was not particularly observed. This is considered to be because the pulp fibers are hydrogen-bonded to each other via the starch.

While the hydrogen bonds between the pulp fibers are nonflexible bonds, the bonds between the pulp fibers via the starch are flexible bonds with mobility because the starch itself is plasticized in the bonds by the moisturizing component and the moisture. As a result, the soft touch of the fiber web is maintained and decrease in strength is reduced.

The technical scope of the present invention is not limited to the respective examples and the components or numerical ranges can be arbitrarily changed without departing from the scope of the present invention.

INDUSTRIAL APPLICABILITY

The fiber web product according to the present invention has a smooth and thick raised feeling, is soft, has a moist texture, generates little dust, hardly causes the dust to fall off, and has a sufficient strength.

Accordingly, the fiber web product is significantly useful as a fiber web product used for hygienic and household uses such as tissue paper, toilet paper, and towel paper.

REFERENCE SIGNS LIST

10: sample
11: folding line
12: raised fiber
21 to 23: slide glass
24: specimen
30: plastic bag
40: rotating shaft
50: particle number measuring device

The invention claimed is:

1. A fiber web product comprising a fiber web that contains hardwood pulp and is impregnated with a chemical solution, the chemical solution containing a moisturizing component, moisture, an oily component, and a vegetable powder containing starch, wherein the fiber web contains 50 wt % or more of the hardwood pulp;

wherein an average particle diameter of the vegetable powder is 5 to 30 μm; and wherein a blending ratio of the moisturizing component, the moisture, the oily component, and the vegetable powder in the chemical solution at 23° C. and a relative humidity of 50% is as follows:

moisturizing component: 1;
moisture: 0.05 to 1.0;
oily component: 0.01 to 1.0; and
vegetable powder: 0.01 to 1.0.

2. The fiber web product according to claim 1, wherein the fiber web is dry crepe paper.

3. The fiber web product according to claim 2, wherein the fiber web contains 90 wt % or more of the hardwood pulp.

4. The fiber web product according to claim 2, wherein the moisturizing component contains glycerin.

5. The fiber web product according to claim 2, wherein the oily component contains hydrocarbons.

6. The fiber web product according to claim 2, wherein the starch is corn starch.

7. The fiber web product according to claim 2, wherein an average particle diameter of the vegetable powder is 2 to 50 μm.

8. The fiber web product according to claim 2, wherein the blending ratio of the moisturizing component, the moisture, the oily component, and the vegetable powder in the chemical solution at 23° C. and a relative humidity of 50% is as follows:

moisturizing component: 1;
moisture: 0.1 to 0.5;
oily component: 0.03 to 0.5; and
vegetable powder: 0.03 to 0.5.

9. The fiber web product according to claim 2, wherein the vegetable powder intervenes between pulp fibers of the fiber web in which hydrogen bonds are relaxed by the moisturizing component and the oily component, to raise the pulp fibers.

10. The fiber web product according to claim 1, wherein the fiber web contains 90 wt % or more of the hardwood pulp.

11. The fiber web product according to claim 1, wherein the moisturizing component contains glycerin.

12. The fiber web product according to claim 1, wherein the oily component contains hydrocarbons.

13. The fiber web product according to claim 1, wherein the starch is corn starch.

14. The fiber web product according to claim 1, wherein an average particle diameter of the vegetable powder is 2 to 50 μm.

15. The fiber web product according to claim 1, wherein the blending ratio of the moisturizing component, the moisture, the oily component, and the vegetable powder in the chemical solution at 23° C. and a relative humidity of 50% is as follows:

moisturizing component: 1;
moisture: 0.1 to 0.5;
oily component: 0.03 to 0.5; and
vegetable powder: 0.03 to 0.5.

16. The fiber web product according to claim 1, wherein the vegetable powder intervenes between pulp fibers of the fiber web in which hydrogen bonds are relaxed by the moisturizing component and the oily component, to raise the pulp fibers.

17. The fiber web product according to claim 16, wherein number of the pulp fibers raised to protrude and have a height of 0.1 mm or more from a surface of the fiber web is 400 or more per 160 $mm^2$ of a surface area of the fiber web.

18. The fiber web product according to claim 16, wherein number of particles of dust that contains the vegetable powder or the pulp fibers, is generated from the fiber web, and falls off from the fiber web is 6000 or less per 1800 $cm^2$ of the surface area of the fiber web.

19. A manufacturing method of a fiber web product, comprising:

preparing a chemical solution containing a moisturizing component, moisture, an oily component, a vegetable powder containing starch, and a surfactant; and impregnating a fiber web containing hardwood pulp with the chemical solution by spraying or roll coating, and wherein the fiber web contains 50 wt % or more of the hardwood pulp;

wherein an average particle diameter of the vegetable powder is 5 to 30 μm; and wherein a blending ratio of the moisturizing component, the moisture, the oily component, and the vegetable powder in the chemical solution at 23° C. and a relative humidity of 50% is as follows:

moisturizing component: 1;
moisture: 0.05 to 1.0;
oily component: 0.01 to 1.0; and
vegetable powder: 0.01 to 1.0.

20. The manufacturing method of a fiber web product according to claim 19, wherein the chemical solution is prepared by blending the starch that is the vegetable powder to an emulsion containing the moisturizing component, the moisture, the oily component, and the surfactant while a temperature of the emulsion is maintained at 60° C. or less, and the fiber web is impregnated with the chemical solution at a temperature of 60° C. or less.

* * * * *